US006730881B1

(12) United States Patent
Arntz et al.

(10) Patent No.: US 6,730,881 B1
(45) Date of Patent: May 4, 2004

(54) COOKING APPLIANCE HAVING ACCELERATED COOKING SYSTEM

(75) Inventors: Timothy J. Arntz, Cleveland, TN (US); Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/318,127

(22) Filed: Dec. 13, 2002

(51) Int. Cl.[7] ..... F24C 15/32; A21B 1/26

(52) U.S. Cl. ..... 219/400; 219/681; 219/685; 219/393; 219/411; 99/476

(58) Field of Search ..... 219/400, 395, 219/396, 398, 411, 681, 685; 126/21 A; 99/331, 340, 474–476

(56) References Cited

U.S. PATENT DOCUMENTS

| | | | | |
|---|---|---|---|---|
| 3,861,378 A | * | 1/1975 | Rhoads et al. | 126/21 A |
| 4,357,522 A | | 11/1982 | Husslein et al. | |
| 4,395,233 A | | 7/1983 | Smith et al. | |
| 4,516,012 A | | 5/1985 | Smith et al. | |
| 4,555,606 A | | 11/1985 | Thomas et al. | |
| 4,648,377 A | | 3/1987 | Van Camp | |
| 4,909,236 A | | 3/1990 | Del Fabbro | |
| 5,254,823 A | | 10/1993 | McKee et al. | |
| 5,434,390 A | | 7/1995 | McKee et al. | |
| 5,471,972 A | | 12/1995 | Corliss, II et al. | |
| 5,497,760 A | | 3/1996 | Alden et al. | |
| 5,676,870 A | | 10/1997 | Wassman et al. | |
| 5,756,974 A | | 5/1998 | Hong | |
| 5,927,265 A | | 7/1999 | McKee et al. | |
| 5,937,845 A | | 8/1999 | Gladd, Sr. | |
| 6,218,651 B1 | | 4/2001 | Chung | |
| 6,250,296 B1 | | 6/2001 | Norris et al. | |
| 6,346,691 B2 | * | 2/2002 | Kim et al. | 219/681 |

FOREIGN PATENT DOCUMENTS

| | | | |
|---|---|---|---|
| JP | 62-268919 | * | 11/1987 |
| JP | 04-190017 | * | 7/1992 |

* cited by examiner

*Primary Examiner*—Joseph Pelham
(74) *Attorney, Agent, or Firm*—Diederiks & Whitelaw, PLC

(57) ABSTRACT

An accelerated cooking feature for use in an appliance having an oven cavity includes a forced air convection system having an electronic control unit, a variable speed, bi-directional fan motor, and a directionally vented cover plate. The appliance operates in at least three modes, constituted by a convection mode, a radiant bake mode and a self-clean mode. In the convection mode, the controller operates the fan motor in a first direction at a speed dependent upon a selected cooking process, with various air streams being directed into distinct regions of the oven cavity. During the radiant bake mode, the controller operates the fan motor in a reverse direction to establish a uniform cooking environment. In the self-clean mode, high speed air currents are directed into the oven cavity and, in combination with a top broil element, perform a pyrolytic cleaning process.

19 Claims, 3 Drawing Sheets

COOKING APPLIANCE HAVING ACCELERATED COOKING SYSTEM

BACKGROUND OF THE INVENTION

1. Field of the Invention

The present invention pertains to the art of cooking appliances and, more particularly, to a cooking appliance including a variable speed, bi-directional forced airflow system capable of rapidly and effectively performing a convection cooking process.

2. Discussion of the Prior Art

The demand for cooking appliances possessing the ability to both rapidly and effectively cook a wide variety of food items is on the rise. Individuals and businesses who prepare food have long searched for the fastest and most efficient approach to cooking. However, the problem with designing an oven capable of rapidly and effectively cooking a food item is exacerbated by the wide array of consumer tastes. No single cooking process lends itself to efficiently cook the wide variety of food items desired by consumers.

For example, while conventional or radiant heat cooking is suitable to a wide assortment of food types, the overall cooking process, especially baking, can be quite slow. The pre-heat time, combined with the cook time, is longer than most businesses or consumers desire. In addition, the dry, hot environment associated with a convection oven tends to absorb moisture contained within the food item. As a result, the quality of the finished product can be less than desirable.

Microwave ovens, on the other hand, are capable of performing a rapid cooking operation. Unfortunately, the types of food items and cooking processes found to be suitable for microwave cooking are limited. At the present time, microwaves, by themselves, are often not suitable for baking or for preparing food items which require a crunchy texture. For instance, pastries and other doughy food items tend to become soggy after exposure to a microwave cooking process.

Yet another method of rapidly cooking a food item is through forced air convection. Forced air convection allows for cooking at lower temperatures as compared to conventional radiant cooking processes. It has been shown that, by directing forced air streams over a food item, the time required to perform the cooking process is reduced. The forced air streams serve to disrupt a thermal insulation layer about the food item which increases the heat transfer rate between the food item and its surroundings. While effective to a large degree, like microwave cooking, forced air is not suitable to all types of food items or cooking processes. Red meats, for example, do not withstand the effects of convection cooking very well, nor is convection cooking extremely effective for performing a baking process. Furthermore, not every food type or cooking process requires the same forced air flow. A flow rate which is too high or too low can detrimentally alter the overall quality of the finished food product.

Accordingly, a design that incorporates a forced air convection system capable of performing both convection and standard radiant bake cooking can enable a business or individual to cook an appetizing meal in a short time period. The optional incorporation of microwave cooking system can further reduce the cook time and, properly regulated, be used to effectively perform a variety of quality cooking operations. The prior art has many examples of ovens which combine several types of cooking processes. However, most are limited in the types of cooking processes performed. Accordingly, based on at least these reasons, there still exists a need in the art for a cooking appliance capable of rapidly and efficiently cooking food items, while being adaptable to effectively perform a variety of cooking processes for a wide range of foods.

SUMMARY OF THE INVENTION

The present invention is directed to a cooking appliance including an oven cavity having a plurality of zones, an electronic control unit adapted to receive inputs from a user and subsequently control a cooking operation based, at least in part, on the user inputs, and an accelerated cooking, forced air convection system. Specifically, the forced air convection system includes a bi-directional, variable speed fan motor and a central vented cover about which is arranged a halo heating element and a peripheral vent. In one arrangement, an air stream is directed through a distinct region disposed about the vented cover plate which acts to direct an air stream into each of the plurality of oven cavity zones after circulating within the oven cavity.

In a preferred embodiment, the forced air convection system of the present invention is operable in a plurality of modes depending upon a consumer preference. In a first or convection cooking mode, the bi-directional fan motor operates in a first or forward direction at a selectively variable speed. Particularly, forced air is directed through the fan cover into the oven cavity and returned through the peripheral vent. More specifically, forced air is directed into each of the oven cavity zones at a selectively variable flow rate. In a preferred form of the invention, an optimal flow rate is determined by the electronic control unit based upon a selected cooking process, food item or combination thereof.

The cooking appliance of the present invention is further operable in a second or radiant bake mode. In the radiant bake mode, the bi-directional fan motor operates in a second or reverse direction whereby air is drawn in from the oven cavity through the vented cover and returned to the oven cavity through the peripheral vent. When operating in the second mode, a uniform oven temperature is developed inside the oven cavity, preferably without causing the air stream to impinge directly upon the food.

Finally, the cooking appliance of the present invention is operable in a third or self-clean mode. After a consumer selects the self-clean mode, the bi-directional fan is operated in the first direction at a high speed. In addition, a top mounted broil element is activated to further improve the cleanability in the self-clean mode. In operation, the high speed air stream, in combination with the top broil element, delivers thermal energy to all zones of the oven cavity which serves to combust any accumulated soil, thereby reducing soil build-up within the oven cavity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
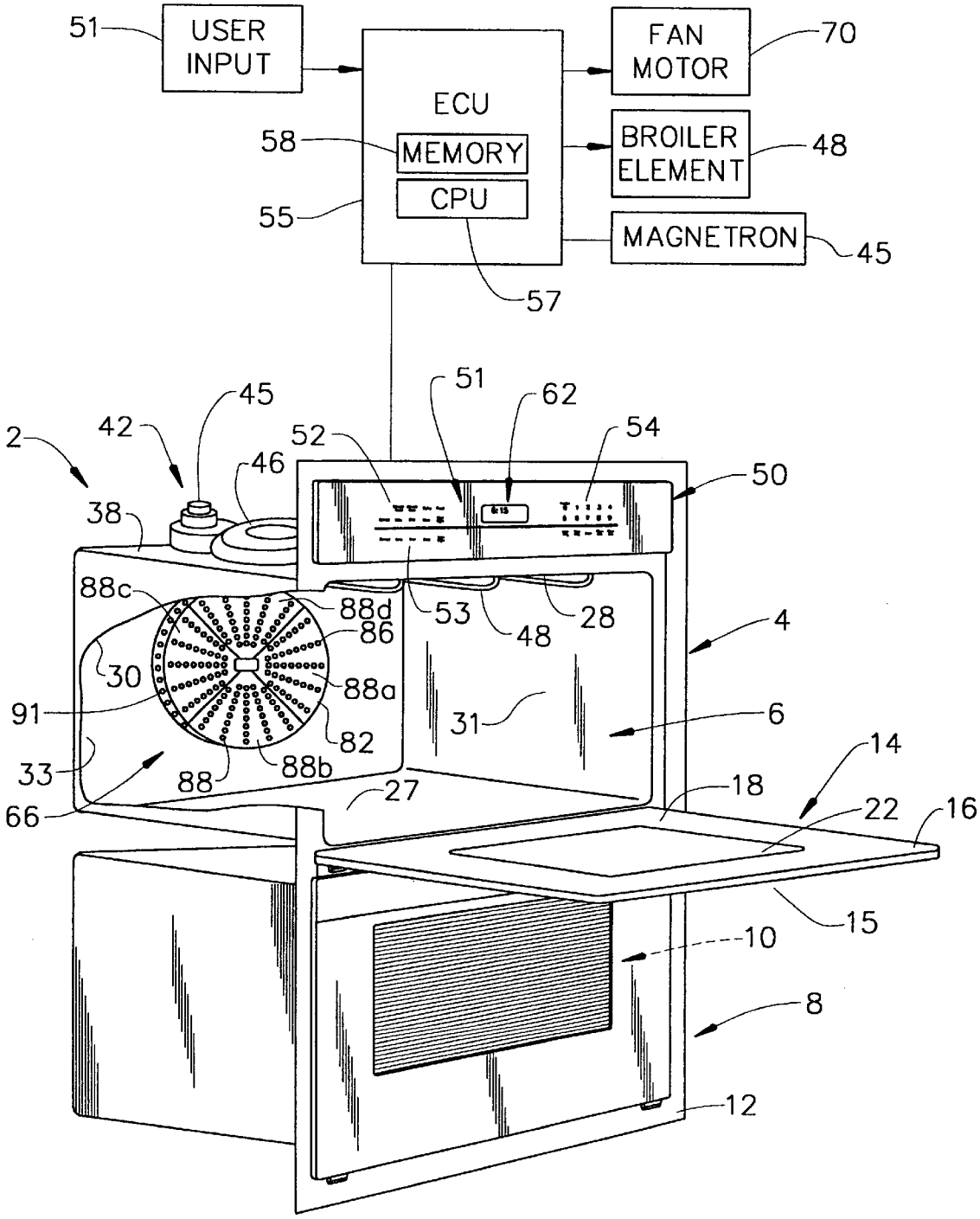
FIG. 1 is a perspective view of a wall oven including an accelerated cooking system constructed in accordance with the present invention.
Figure 2:
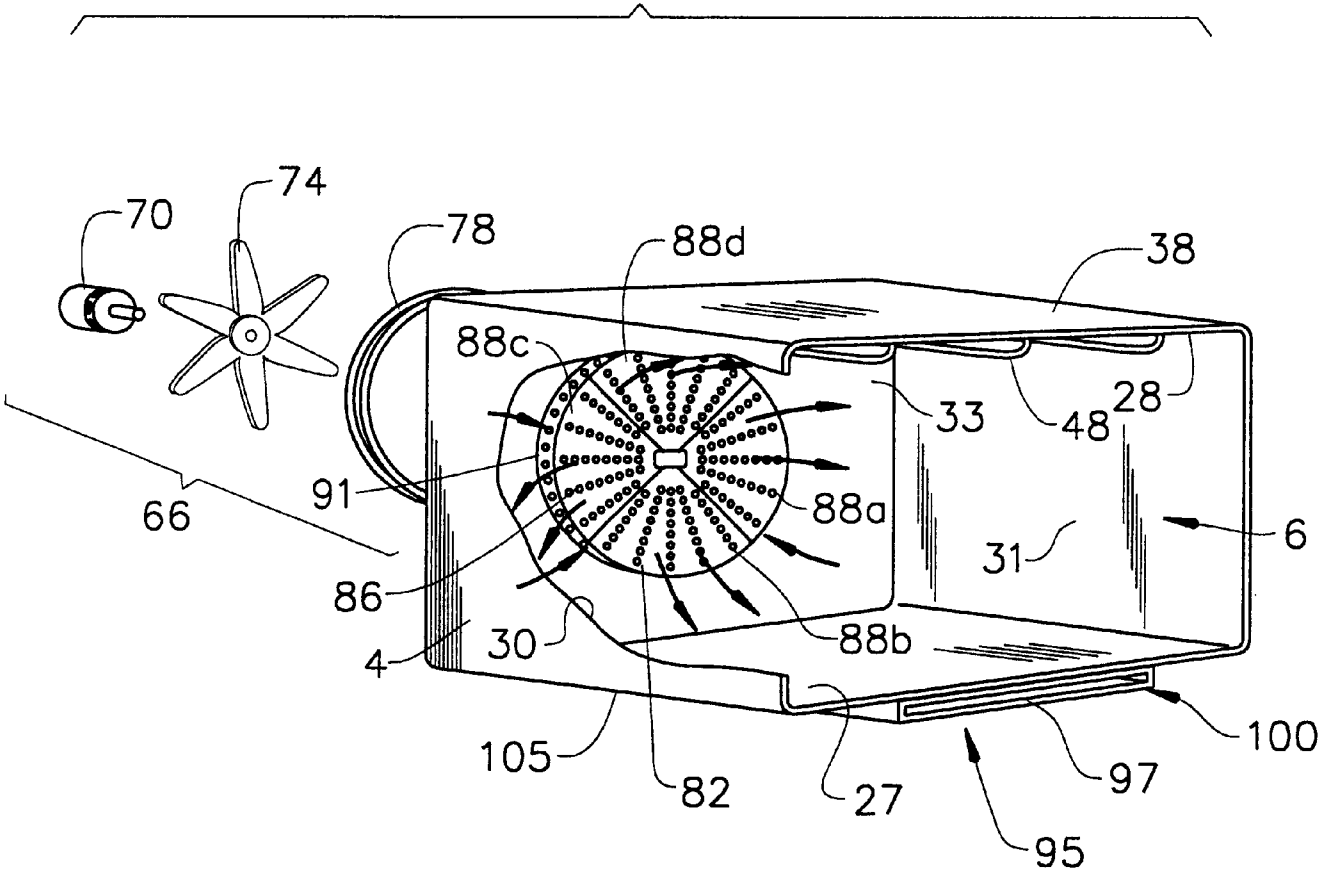
FIG. 2 is an exploded view of the accelerated cooking system constructed in accordance with the present invention shown operating in a forced air convection mode.

With initial reference to FIG. 1, a cooking appliance constructed in accordance with the present invention is generally indicated at 2. Although the actual cooking appliance into which the accelerated cooking system of the invention is incorporated may vary, the invention is shown in connection with cooking appliance 2 which is depicted as a double wall oven. However, it should be understood that the present invention not limited to this model type and can be incorporated into various types of oven configurations, e.g., cabinet mounted ovens, as well as both slide-in and free standing ranges. Specifically, in the embodiment shown, cooking appliance 2 constitutes a dual oven wall unit including an upper oven 4 having upper oven cavity 6 and a lower oven 8 having a lower oven cavity 10. Upper oven 4 is preferably designed to perform an accelerated cooking process, and lower oven 8 is provided to perform a standard, non-convection or radiant heat cooking operation. As shown, cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 is also provided with a handle 15 at an upper portion 16 thereof. Door assembly 14 is adapted to pivot at a lower portion 18 to enable selective access to within oven cavity 6. In a manner also known in the art, door 14 is provided with a transparent zone 22 for viewing the contents of oven cavity 6 while door 14 is closed.

As best seen in FIG. 1, oven cavity 6 is defined by a bottom portion 27, an upper portion 28, opposing side portions 30 and 31 and rear portion 33. In the preferred embodiment shown, bottom portion 27 is constituted by a flat, smooth surface designed to improve the cleanability, serviceability, and reflective qualities of oven cavity 6. Arranged on an exterior upper portion 38 of upper portion 28 is a microwave cooking system 42. As shown, microwave cooking system 42 includes a magnetron 45 having an associated waveguide 46. In addition to microwave cooking system 42, cooking appliance 2 includes a grilling system. Specifically, a top broiler element 48 is arranged on upper portion 28 of oven cavity 6. Top broiler element 48 is provided to enable a consumer to perform a grilling process in upper oven 4 and, as will be discussed more fully below, to aid in pyrolytic heating during a self-clean operation. In the preferred form of the invention, top broiler element 48 is constituted by a sheathed electric resistive heating element.

As further shown in FIG. 1, cooking appliance 2 includes an upper control panel 50 having a plurality of control elements 51. In accordance with one embodiment, control elements 51 are constituted by first and second rows of oven control buttons 52, 53 and a numeric pad 54. In a preferred form of the invention, housed within control panel 50 is an electronic control unit (ECU) 55 including a central processing unit (CPU) 57 with a memory module 58. ECU 55 is adapted to receive inputs from a user and, subsequently, control a desired cooking operation of appliance 2. In one arrangement, electronic control unit 55 is adapted to receive inputs through control buttons 52 and 53 and, in combination with numeric pad 54 and a display 62, enables a user to establish particular cooking operations for upper and lower ovens 4 and 8 respectively. Since the general programming and operation of cooking appliance 2 is well within the skill of an ordinary artisan in this art and does not form part of the present invention, these features will not be discussed further here.

Instead, the present invention is particularly directed to an accelerated cooking or forced air convection system 66 arranged within cooking appliance 2. In accordance with the most preferred form of the present invention, forced air convection system 66 includes a housing (not shown), a variable speed, bi-directional fan motor 70, a fan 74, a halo heating element 78 constituted by a plurality of substantially annular rings, and a fan cover plate 82. As will become more fully evident below, cover plate 82 is constituted by a plurality of directional vents 86, such as angled air openings, arranged in a plurality of distinct regions 88*a*–88*d* about the surface of cover plate 82. In addition to directing an airflow through vent cover plate 82, a secondary air passage is provided in the form of a peripheral vent 91 extending about a peripheral side portion of cover plate 82.

In accordance with the preferred form of the invention, directional vents 86 of cover plate 82 are adapted to direct a heated airflow into oven cavity 6. More specifically, directional vents 86 are adapted to direct an air stream into each of a plurality of zones located within oven cavity 6. In the most preferred form of the invention depicted, oven cavity 6 includes four distinct zones or quadrants, i.e., a bottom zone, a right side zone, a left side zone, and a top zone (not separately labeled). Accordingly, each of the plurality of vent regions 88*a*–88*d* is adapted to direct an air stream through directional vents 86 to a respective one of the zones within oven cavity 6, i.e., both forward and towards a respective one of bottom portion 27, side portions 30 and 31, and upper portion 28.

In addition to the components described above, forced air convection system 66 further includes an air circulation or make-up air duct 95 having a first end 97 arranged on an exterior surface 105 of lower portion 27 extending to a second end (not shown) that terminates behind rear portion 33 adjacent to forced air convection system 66. Air duct 95 is specifically provided to lessen the impact of unheated ambient air on the thermal profile of the heated air streams introduced into oven cavity 4 by conditioning or pre-heating the ambient airflow. Besides conditioning the ambient air, air duct 95 can also serve to regulate the temperature of various components of forced air convection system 66, either by passing the airflow past the component within a duct or by providing openings in the duct which can direct a portion of the airflow onto the component to be cooled.

Having described a preferred construction of accelerated cooking system 66 of the present invention, a preferred method of operation will be described below. Through manipulation of a select sequence of control elements 51 (FIG. 1), a consumer can establish a particular cooking operation for appliance 2. In accordance with one embodiment of the present invention, a consumer is presented with at least three options in which cooking appliance 2 can operate, i.e., a forced air convection cooking mode, a radiant-heat bake mode, or a self-clean mode.

Upon selection of the convection cooking mode, electronic control unit 55 signals fan motor 70 to operate in a first or forward direction. Based upon the selected cooking process, controller 55 establishes an optimum speed for fan motor 70 which rotates fan 74 to establish convective air streams which are directed into the plurality of zones in oven cavity 6. Prior thereto, the convective air streams are heated by being directed passed halo heating element 78 arranged behind fan cover plate 82.

As indicated above, the convective air streams are passed through several distinct regions 88*a*–88*d* arranged about fan cover plate 82. With this arrangement, the convective air streams are substantially, uniformly directed throughout oven cavity 6 such that the convective air streams circulate about and impinge upon the food item(s) undergoing the cooking process from various directions. As the convective air streams circulate about oven cavity 6, they are returned to forced air convection system 66 through peripheral vent 91. In addition, forced air convection system 66 receives an input or make-up airflow through air duct 95. Specifically, as fan 74 rotates, air is drawn in through duct 95 and combined with the air flow through peripheral vent 91 prior to being passed over halo element 78. A portion of the return air streams is also exhausted to the outside of the system which the remainder is reintroduced into oven cavity 6.

Figure 3:
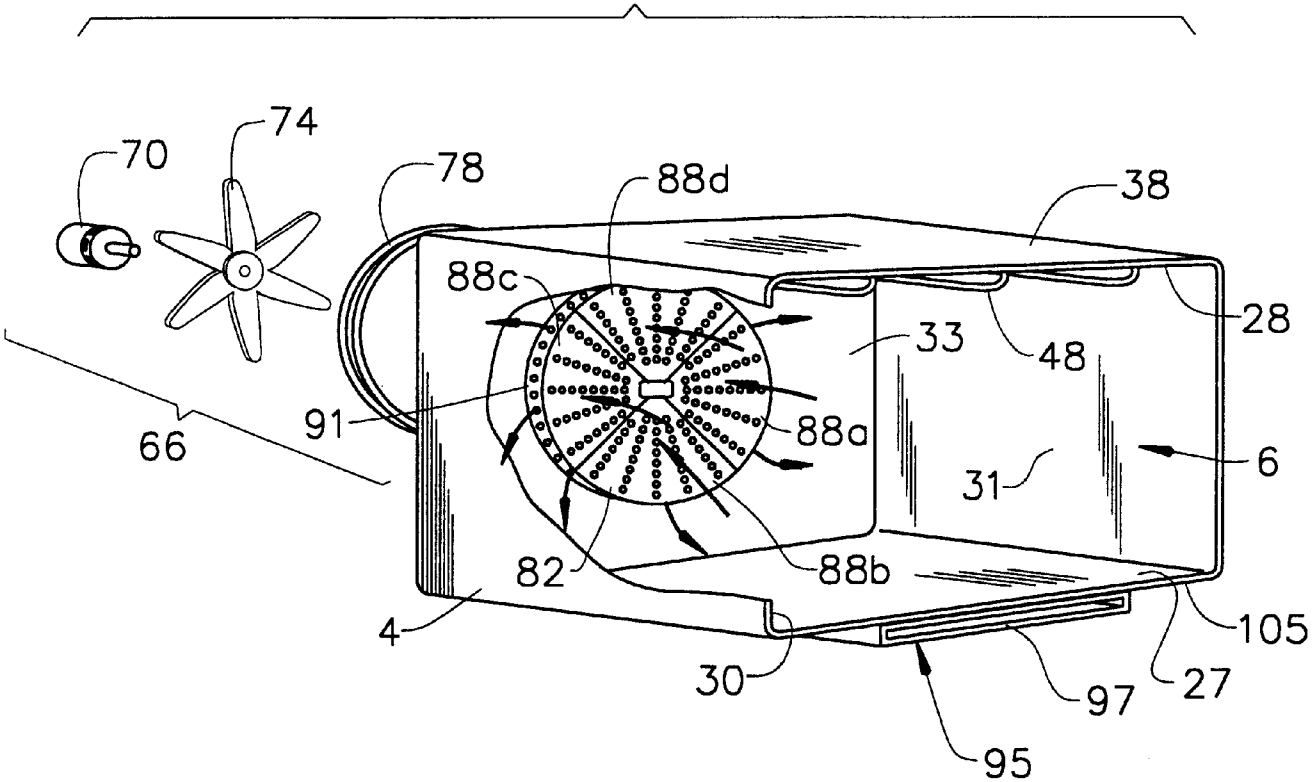
FIG. 3 is an exploded view of the accelerated cooking system constructed in accordance with the present invention shown operating in a radiant bake mode.

Normal or non-convective cooking is performed by selecting the radiant-bake mode. Referring to FIGS. 1 and 3, upon selection of the radiant bake mode, electronic control unit 55 signals fan motor 70 to rotate in a second direction, opposite to that of the first direction. In this manner, air is drawn in from oven cavity 6 through vent regions 88*a*–88*d* of cover plate 82. As the radiant air flow passes through cover plate 82, the airflow is heated or conditioned as it passes proximate to halo heating element 78. After conditioning, a portion of the radiant air flow is reintroduced into oven cavity 6 through the peripheral vent 91, while the remaining portion is exhausted to the surroundings. The exhausted portion is replaced by air introduced through air duct 95. In this manner, food placed within oven cavity 6 is subjected to a uniform oven heating environment without the direct impingement of hot air jets directly onto the food item(s).

Over time, and after repeated operation of cooking appliance 2, food by-products will begin to accumulate on interior surface portions of oven cavity 6. Accordingly, in accordance with one preferred embodiment, a consumer has the option of selecting a self-clean mode such that a pyrolytic cleaning process is performed. In operation, the pyrolytic cleaning process substantially eliminates the accumulated food by-products which have built-up on the interior surface portions of oven cavity 6. Upon selection of the self-clean mode, electronic control unit 55 signals fan motor 70 to generate high speed air currents for introduction into oven cavity 6. Preferably, fan 74 operates in the first direction to develop high speed air currents which impinge upon the interior surface portions of oven cavity 6. Concurrently, electronic control unit 55 activates top broiler element 48 to provide an additional source of radiant energy onto the interior surface portions of oven cavity 6. As top broiler element 48 is operated in combination with fan motor 70, the combined thermal energy acts to combust the accumulated food by-products, substantially eliminating them from the interior surfaces of oven cavity 6.

Although described with reference to a preferred embodiment of the invention, it should be readily understood that various changes and/or modifications can be made to the invention without departing from the spirit thereof. For instance, the forced air convection mode can be operated in combination with the microwave cooking system. This will expand the types of food and cooking processes suitable for the cooking appliance. Additionally, it should be noted that the particular mounting arrangement of the present invention has been described for exemplary purposes only, and that other arrangements, e.g., mounting the microwave system on the rear of oven cavity 6, falls within the scope of the present invention. Furthermore, while the vented cover is described as a separate element, it could be formed as part of the rear wall of the oven cavity without departing from the present invention. In general, the invention is only intended to be limited by the scope of the following claims.

We claim:

1. A cooking appliance incorporating an accelerated cooking feature comprising:

an oven cavity defining a plurality of zones;

a door pivotally mounted for selectively providing access to the oven cavity;

a control panel including a plurality of control elements for selecting a desired cooking operation;

a convection cooking system including a fan, a vented cover plate adapted to separately direct various air streams into each of the plurality of zones, and a bi-directional, variable speed fan motor having at least two operational modes including a convection heat mode wherein the fan motor is rotated in a first direction causing air streams to be directed into the oven cavity through a first portion of the vented cover plate, and a bake mode wherein air streams are directed from the oven cavity into the first portion of the vented cover plate; and an electronic control unit adapted to control the at least two operational modes based upon the desired cooking operation.

2. The cooking appliance according to claim 1, wherein the first portion of the vented cover plate includes a plurality of directional vents arranged in a plurality of regions, each of said directional vents being adapted to direct an air stream into a corresponding one of the plurality of zones.

3. The cooking appliance according to claim 2, wherein the plurality of regions are defined by four quadrants.

4. The cooking appliance according to claim 1, wherein the vented cover plate includes a second portion distinct from the first portion, wherein air is drawn into the vented cover plate through the second portion when the fan motor is rotated in the first direction.

5. The cooking appliance according to claim 4, wherein the second portion constitutes a peripheral vent arranged about the vented cover plate.

6. The cooking appliance according to claim 1, further comprising: a microwave cooking system including a microwave generator, said microwave cooking system being adapted to perform at least a portion of the desired cooking operation.

7. The cooking appliance according to claim 6, further comprising: a broil element arranged within an upper portion of the oven cavity.

8. The cooking appliance according to claim 7, wherein the broil element constitutes a sheathed, resistive electric heating element.

9. The cooking appliance according to claim 1, wherein the convection cooking system further includes a convective heat element for heating the air streams.

10. The cooking appliance according to claim 9, wherein the convective heat element includes a plurality of substantially annular rings.

11. The cooking appliance according to claim 1, wherein said fan motor can further operate in a self-clean mode wherein the fan is rotated in the first direction at a high speed to cause air currents to be generated within the oven cavity.

12. The cooking appliance according to claim 1, further comprising: means for conditioning air for the air streams.

13. The cooking appliance according to claim 12, wherein said conditioning means comprises a duct for directing air along at least a portion of the oven cavity prior to delivery to the vented cover plate.

14. A method of performing an accelerated cooking process in an oven cavity of a cooking appliance including a convection cooking system having a bi-directional, variable speed fan motor and a vented cover plate comprising:

placing a food item into the oven cavity;

initiating the accelerated cooking process;

performing a convection cooking process by operating the fan in a first direction and at a first speed establishing a convective airflow through a plurality of directional vent openings provided in the vented cover plate and performing a self-clean process by operating the bi-directional fan in the first direction and at a second speed which is higher than the first speed.

15. The method according to claim 14, further comprising: directing the convective airflow directly into a plurality of zones defining upper, lower and opposing side regions of the oven cavity.

16. The method according to claim 14, further comprising: performing a bake process by operating the fan in a second direction wherein heated air is drawn in from the oven cavity into the vented cover plate and a baking airflow is directed into the oven cavity through a peripheral vent portion of the vented cover plate.

17. The method according to claim 14, further comprising:

operating a broil element, located in the oven cavity during the self-clean process.

18. The method according to claim 14, further comprising: directing the convective airflow passed a heating element of the convection cooking system prior to delivering the convective airflow through the plurality of directional vent openings.

19. A method of performing an accelerated cooking process in an oven cavity of a cooking appliance including a convection cooking system having a bi-directional, variable speed fan motor and a vented cover plate comprising:

placing a food item into the oven cavity initiating the accelerated cooking process;

performing a convection cooking process by operating the fan in a first direction and at a first speed establishing a convective airflow through a plurality of directional vent openings provided in the vented cover plate; and conditioning air for the convective airflow by directing the air along a portion of the oven cavity prior to delivery to the plurality of directional vent openings.

* * * * *